United States Patent [19]

Burke

[11] Patent Number: 4,545,288

[45] Date of Patent: Oct. 8, 1985

[54] QUARTER TURN ACTUATORS

[75] Inventor: Alun Burke, Midhurst, England

[73] Assignee: Rodyne Limited, Kent, England

[21] Appl. No.: 381,793

[22] Filed: May 25, 1982

[51] Int. Cl.[4] ..... F01B 25/26; F01B 31/12

[52] U.S. Cl. ..... 92/5 R; 92/136; 92/212

[58] Field of Search ..... 92/136, 138, 69 R, 75, 92/50, 248, 5 R, 13.6, 212, 224, 225, 228, 229, 169

[56] References Cited

U.S. PATENT DOCUMENTS

| | | | |
|---|---|---|---|
| 1,156,590 | 10/1915 | Doval | 92/212 |
| 1,388,552 | 8/1921 | Corser | 92/224 |
| 1,490,849 | 4/1924 | Philip | 92/224 |
| 2,123,181 | 7/1938 | Deputy | 92/225 |
| 2,844,127 | 7/1958 | Steiner | 92/136 |
| 3,040,712 | 7/1962 | Harrah | 92/170 |
| 3,148,595 | 9/1964 | Looney | 92/169 X |
| 3,155,014 | 11/1964 | Genz | 92/254 |
| 3,156,160 | 11/1964 | Meyer et al. | 92/13.6 |
| 3,411,409 | 11/1968 | Bunyard | 91/1 |
| 3,971,296 | 7/1976 | Tugwell | 92/69 R |
| 4,081,984 | 4/1978 | Gustafsson et al. | 92/169 X |
| 4,167,897 | 9/1979 | Bunyard | 92/69 R |
| 4,203,351 | 5/1980 | Schwind | 92/69 R |
| 4,207,807 | 7/1980 | Takata et al. | 92/170 |
| 4,257,313 | 3/1981 | Sheppard | 92/127 X |
| 4,260,128 | 4/1981 | Tito | 92/133 X |
| 4,306,489 | 12/1981 | Driver et al. | 92/224 |
| 4,309,937 | 1/1982 | Schardt | 92/248 |
| 4,334,507 | 6/1982 | Köhnert et al. | 92/224 |
| 4,392,631 | 7/1983 | DeWald | 92/136 |

*Primary Examiner*—Sheldon J. Richter
*Assistant Examiner*—Randolph A. Smith
*Attorney, Agent, or Firm*—Frishauf, Holtz, Goodman & Woodward

[57] ABSTRACT

A quarter turn actuator comprises a body (10) defining side-by-side cylinders (11 and 12), a piston (13) in each cylinder having in one side thereof a recess in which is provided a rack (15), a pinion (16) mounted in the body and engaging the racks on the pistons, a source for supplying compressed air to the cylinders and an air distribution system interconnecting each end of each cylinder with the other end of the other cylinder. The body (10) is preferably molded of plastic material and the cylinders are lined. The pistons may also be molded plastic material.

16 Claims, 23 Drawing Figures

QUARTER TURN ACTUATORS

BACKGROUND OF THE INVENTION

This invention is concerned with a quarter turn valve actuator.

Remote actuation of valves in pipelines is an increasing requirement in many situations and is achieved in modern practice by means of a quarter turn actuator, i.e. an actuator which moves the valve stem of ball, butterfly or plug valves the quarter turn from the fully open to the fully closed positions.

Such actuators may be electrically or pneumatically operated and of these two types the pneumatically operated type is generally preferred.

It is an object of the present invention to provide a pneumatic quarter turn valve actuator that is inexpensive, efficient and, to take account of the adverse conditions in which such actuators are often used, highly resistant to corrosion.

SUMMARY OF THE INVENTION

The present invention is directed to a quarter turn actuator comprising a body defining side-by-side cylinders, a piston in each said cylinder having in one side thereof a recess in which is provided a rack, a pinion mounted in said body and engaging the racks on said pistons, means for supplying compressed air to said cylinders and an air distribution system interconnecting each end of each cylinder with the other end of the other cylinder, said piston having a plastic body.

The present invention is also directed to a quarter turn actuator comprising a body defining side-by-side cylinders, a piston in each said cylinder having in one side thereof a recess in which is provided a rack, a pinion mounted in said body and engaging the racks on said pistons, means for supplying compressed air to said cylinders and an air distribution system interconnecting each end of each cylinder with the other end of the other cylinder, at least one piston having a blind bore extending from one end thereof towards the other, and a spring located in said bore and acting to bias the piston to one end of its cylinder.

DETAILED DESCRIPTION

Figure 1:
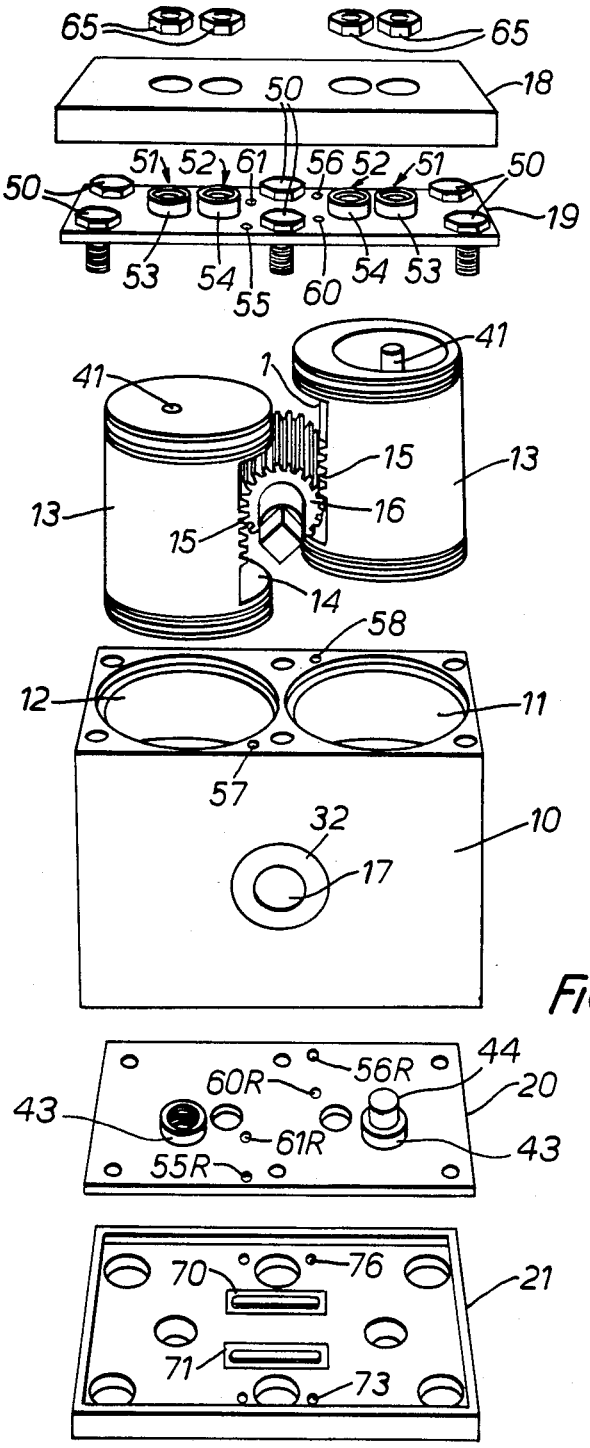
FIG. 1 is an exploded view of an actuator according to the present invention.

Referring now to FIG. 1 of the drawings, a quarter turn actuator according to the preferred embodiment of the present invention comprises a body 10 in which are formed two parallel cylinders 11 and 12, a pair of pistons 13 each having a recess 14 in its side in which is provided a rack 15, a central pinion gear 16 in engagement with the pinion racks 15 and located in the body 10 in a transverse bore 17 which intercepts both cylinders 11 and 12, and front and rear end plates 18 and 19, and 20 and 21, which serve to close off the cylinder ends.

Figure 2:
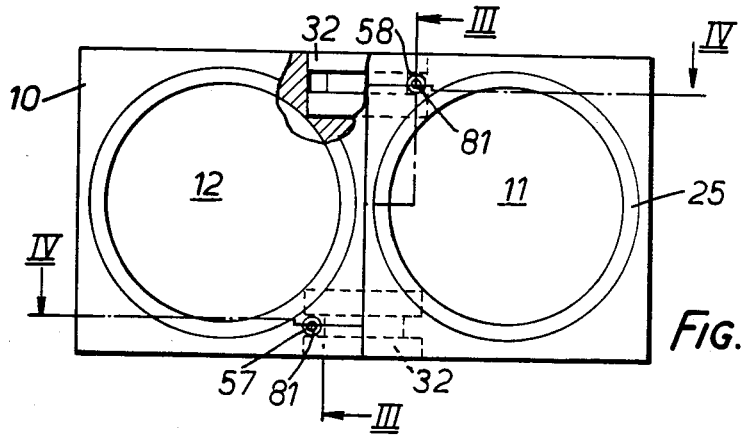
FIG. 2 is an end elevation of the main body of the actuator.
Figure 3:
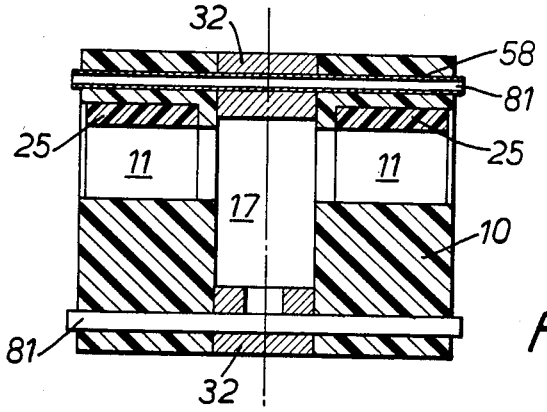
FIG. 3 is a section on the line III—III of FIG. 2.
Figure 4:
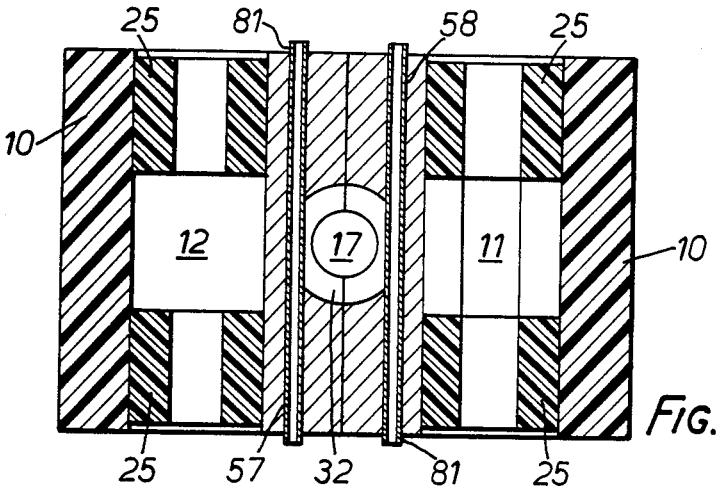
FIG. 4 is a section on the line IV—IV of FIG. 2.

In this preferred embodiment the body 10 is a single precision casting of a glass filled epoxy resin and the cylinders are lined with polytetrafluorethylene (PTFE) impregnated glass filament wound epoxy tubes or liners 25 as seen in FIGS. 2 to 4. In this embodiment two short liners 25 are provided in each cylinder, but equally a single, full length liner could be used in each cylinder, the liner being notched to accommodate the central gear 16. The liners 25 may be secured in position after the main body 10 has been cast but are preferably located in position in the main casting mould and thus cast in position with the main body.

The cylinder liners 25 are produced on highly polished mandrels ensuring high dimensional accuracy and excellent surface finish. The other desirable characteristic of the epoxy liners is that they are extremely strong—a typical liner will withstand an internal pressure of 300 bars while an operating pressure of 7 bars is all that is intended. The strength of the liners 25 is such as to shield the epoxy body 10 from the internal pressures so that the body acts in effect only to locate the other components in their proper relative positions. It should also be noted that at least the inner layer of each cylinder liner is impregnated with PTFE allowing operation of the actuator in completely dry air. It is, of course, not necessary to use epoxy tubes as the liners as conventional metal tubing is also satisfactory.

Figure 18:
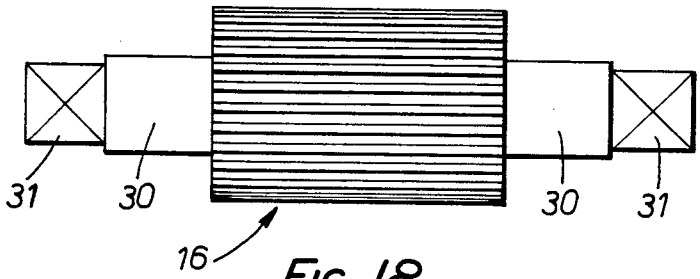
FIG. 18 is an elevation of a central pinion gear of the embodiment of FIG. 1.

The central pinion gear 16 is conventional in construction being simply machined out of a solid metal bar, and, as shown in FIG. 18, is provided with a bearing surface 30 and a male drive square 31 at each end. The bearing surfaces 30 engage collars 32 in this embodiment made of stainless steel and mounted in the body 10 as will be discussed in more detail later.

Figure 11:
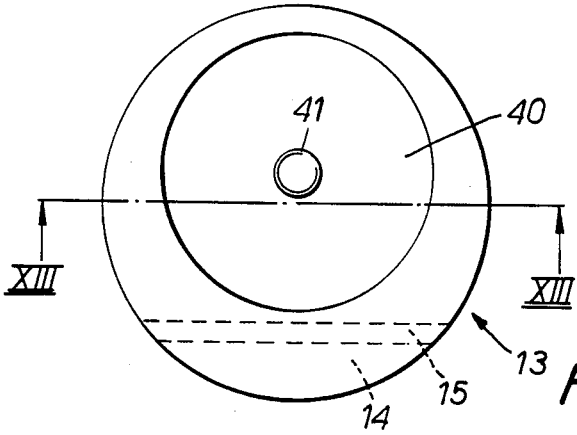
FIG. 11 is an end elevation of a piston of the embodiment of FIG. 1.
Figure 12:
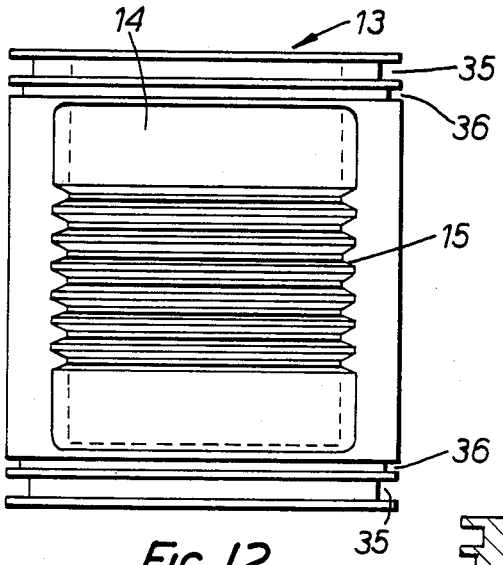
FIG. 12 is a side elevation of the piston of FIG. 11.
Figure 13:
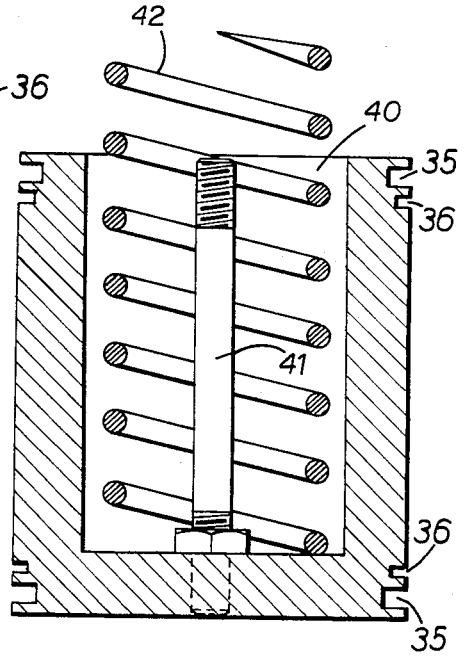
FIG. 13 is a sectional view on the line XIII—XIII of FIG. 11.
Figure 14:
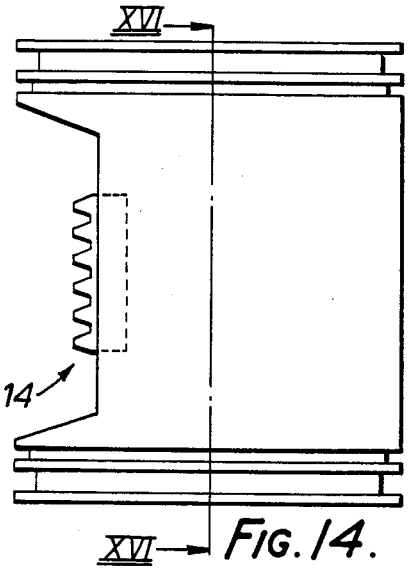
FIGS. 14 and 15 are front and side elevations of modified pistons.
Figure 17:
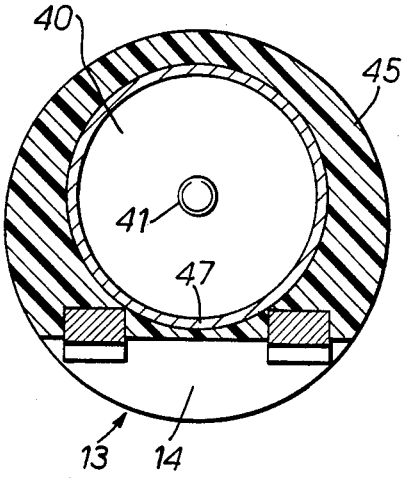
FIG. 17 is a section on the line XVII—XVII of FIG. 16.
Figure 15:
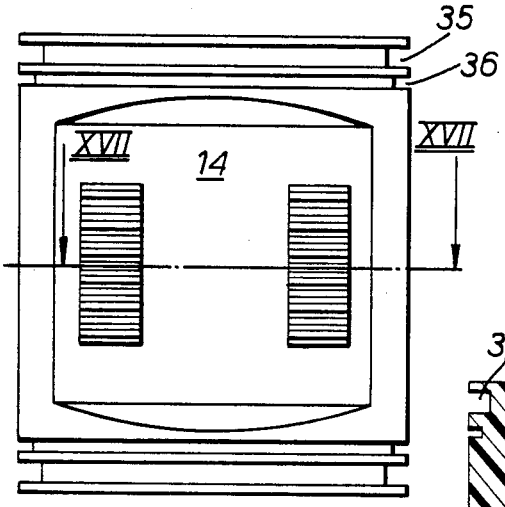
Figure 16:
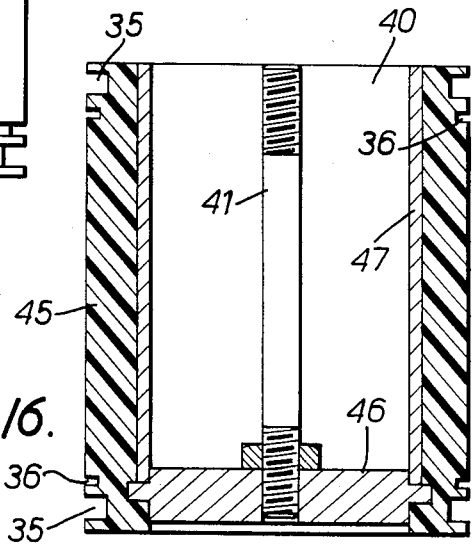
FIG. 16 is a section on the line XVI—XVI of FIG. 14.

The two pistons 13 are in fact identical and carry at each end a piston ring and a full diameter acetal bearing ring in grooves 35 and 36 (FIGS. 11 to 13). Bearing rings of the maximum possible diameter are necessary to absorb the side loads and pitching movements caused by the rack and pinion construction. In the side of each piston is formed the recess 14 in which is located a rack 15. The piston body is hollow, an eccentric blind bore 40 extending from one end of the piston 13 almost to the other end. Centrally located in the bore 40 is a stud 41 which is screwed into a hole in the closed end of the piston 13 and extends to near the plane of the open end of the piston.

The piston of FIGS. 11 to 13 is conventional in construction and requires either a lot of machining or costly investment in tooling for a pressure die casting. Also, if, as would be normal, the piston is made from aluminium then the rack teeth would also necessarily be made of aluminium.

To overcome these disadvantages a preferred construction of the piston 13 has been developed and is illustrated in FIGS. 14 to 17. This modified piston 13 has the same external features as the piston of FIGS. 11 to 13, i.e. grooves 35 and 36, bore 40, stud 41, recess 14 and rack 15 (now in two spaced lengths) but the construction is entirely different. The wall 45 of the piston 13 is an epoxy casting and carries a metal disc 46 forming the piston head, and mounting the stud 41, and a strengthening tube 47 which may be either metal or a filament wound plastic tube. The disc 46 and tube 47 may be either cast in position or may be fitted retrospectively desired.

The rack, in this form of piston, comprises two short lengths of standard steel rack. Clearly the lengths of rack may be located in position during the casting process or may be subsequently bonded in recesses in the cast piston.

The end plate 19 is metal and is secured by six bolts 50 to the front face of the body 10. Over each cylinder space are located two holes 51 and 52 each carrying a tapped insert 53 and 54 respectively, the holes 51 being coaxial with the piston studs 41. The inserts 53 carry adjustable endstops which cooperate with the studs 41 to limit the travel of the pistons and therefore the angle through which the pinion 16 turns. The adjustable limits are a simple method of ensuring not so much that the pinion does turn through 90° but rather the pinion turns the 90° between the fully open and fully closed positions of a valve controlled by the actuator. The inserts 54 are provided for connection with the external compressed air lines.

A further pair of holes 55 and 56 are provided in the plate 19 in alignment with passages 57 and 58 running through the body 10, while holes 60 and 61 are also provided, in alignment with the cylinders, 11 and 12 respectively.

The end plate 20 is similar to the plate 19 except that threaded inserts 43 are provided only in the holes coaxial with the studs 41, and then only if desired for fitting proximity detectors 44 which, cooperating with the studs 41, can give an indication of the operating condition of the actuator and thus of whether the valve controlled is in the open or closed condition.

The end plates 18 and 21 are epoxy castings and are very similar, the difference being that the plate 21 contains, for each cylinder, a single hole aligned with the stud 41 while the plate 18 contains two holes. The inserts pass through the holes in the plates 18 and 21 and locknuts 65 engage the external threads on the inserts to secure the end plates 18 in position. Additional screws may be provided if desired. As so far described it can be seen that the plates 19 and 20 provide the strength necessary to absorb the impact of the pistons at the end of their stroke while the plates 18 provide a "clean" end surface and effectively enclose and protect the plates 19 and 20 and the bolts 50 so that these components may be made of low cost materials rather than expensive corrosion resistant stainless steel. A third function is provided by the end plates 18 and 21, namely that of air distribution.

Figure 21:
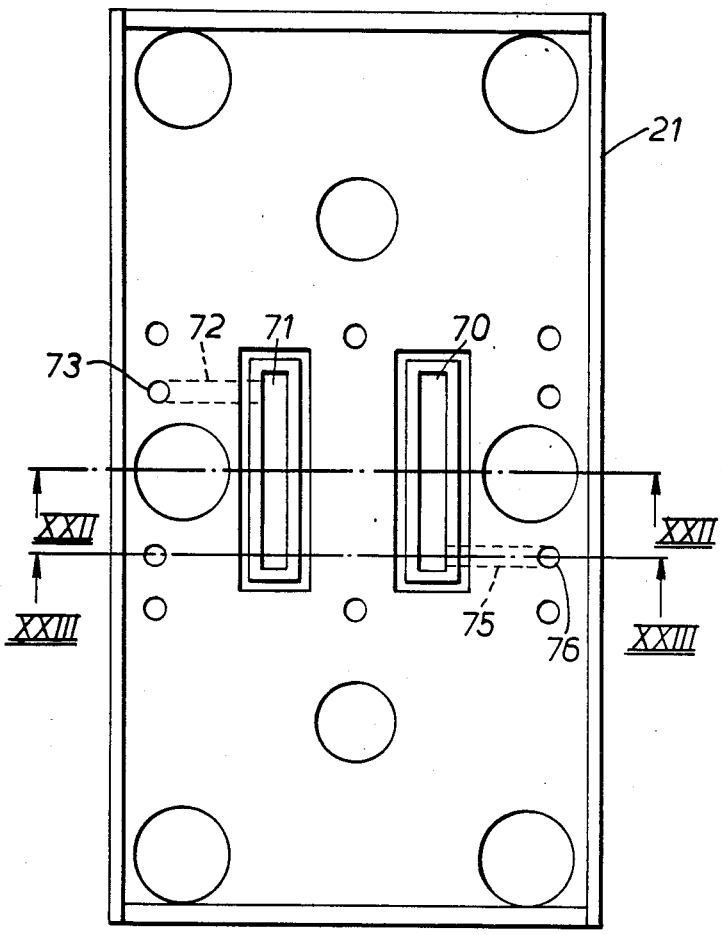
FIG. 21 is an elevation of an end plate used in the embodiment of FIG. 1.
Figure 22:
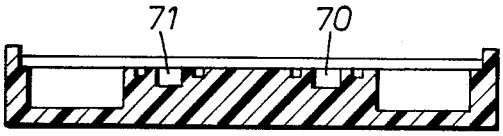
FIGS. 22 and 23 are sectional views on the lines XXII—XXII and XXIII—XXIII of FIG. 21, respectively.
Figure 23:
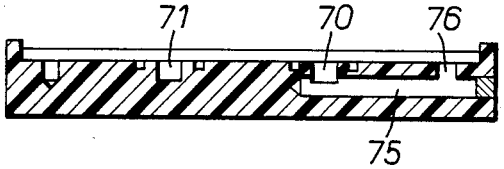

Reverting briefly to FIG. 1, it can be seen that by applying compressed air to opposite ends of respective cylinders 11, the pistons 13 will move in opposite directions to apply similar torques to the pinion gear 16. As it is desired to supply compressed air to only one end of the actuator it is necessary to provide an air distribution system from one end of a cylinder to the opposite end of the other cylinder. This distribution system is provided in the end plates 18 and 21 and by the passages 57 and 58 running through the block. FIGS. 21 to 23 show details of the passages in the block 21.

Two grooves 70 and 71, surrounded by seals, are provided on the inner surface of the plate 21. From one end of the groove 71 a passage 72 leads to a bore 73 which comes back to the surface of the plate. The same end of the groove 70 communicates with the rear of cylinder 12 via the hole 61R in the plate 20, while the bore 73 communicates with the passage 57 which extends through to the other end of the body 10 in register with a hole 55 in the plate 19, bore 73, passage 72, groove 71 in the plate 18 and through hole 60 at the other end of the groove 71 to the front end of the cylinder 11.

Figure 6:
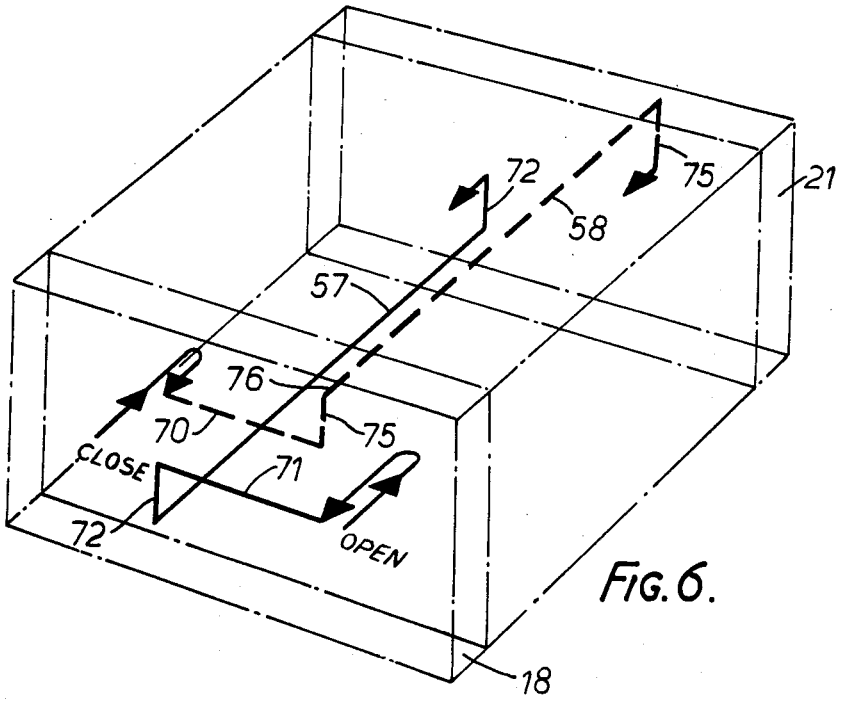
FIG. 6 diagrammatically illustrates the air passages between the two ends of the actuator body using the arrangement of FIG. 4.

In the same way there is communication between the front end of cylinder 12 and the rear end of cylinder 11 by way of the length of the groove 70, passage 75 and bore 76 in the plate 18, passage 58 in the body 10, bore 76 and passage 75 in the plate 21 and through hole 60R in the plate 20. This air distribution system is seen schematically in FIG. 6.

The air passages 57 and 58 are located in the body to interact with the collars 32 (FIGS. 2, 3, 4) in which the bearing surfaces 30 of the central gear 16 are located. The collars 32, seen best in FIG. 8, have a circumferential groove 80 and a tube 81 in each passage serves to engage the groove and lock the collar 32 in position. Locking of the collars 32, of course, securely locates the gear 16 in position.

Figure 9:
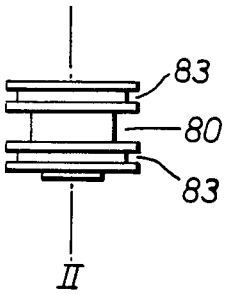

In an alternative embodiment the tubes are dispensed with and the collars have the form of FIG. 9 in which grooves 83 on either side of the groove 80 receive sealing O-rings. In this case, of course, it is necessary to secure the collars in position by other means, for example, bonding or locking screws.

Figure 7:
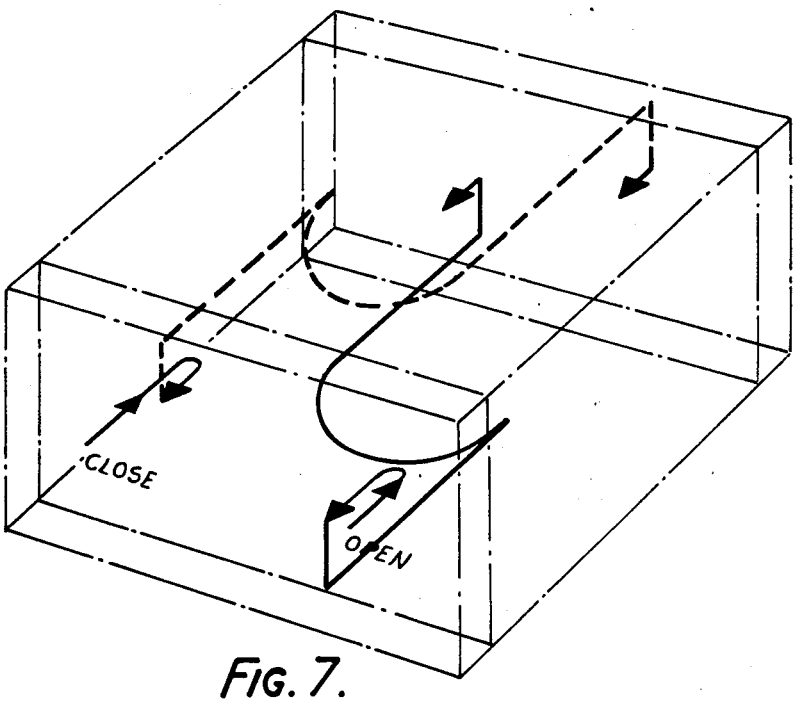
FIG. 7 is similar to FIG. 6 but uses the modification of FIG. 5.
Figure 8:
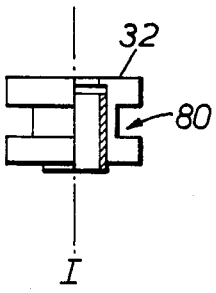
FIGS. 8, 9 and 10 illustrate various collars that may be used in different embodiments of the invention.

The collars of FIGS. 8 or 9 could be used with the alternative air distribution system illustrated schematically in FIG. 7.

Figure 5:
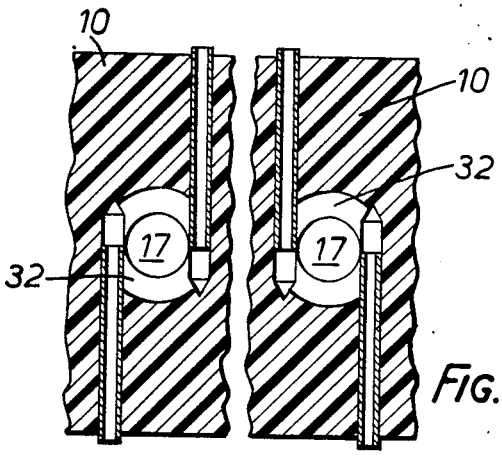
FIG. 5 shows details of a modification of the embodiment of FIG. 1.

In the system of FIG. 7, the connections from one side of the body 10 to the other takes place in the grooves 80 in the collars rather than through the grooves 70 and 71 in an end plate. The details of this at the collar 32 are shown in FIG. 5 and clearly the passages 57 and 58 and the end plates require modification.

Figure 10:
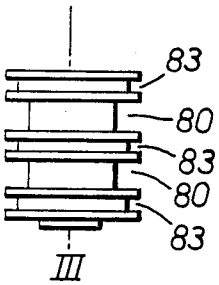

A further modification of the collar system is to provide at one end of the gear 16 a plain collar and at the other end a double grooved collar as shown in FIG. 10. In this case also the air passages through the body 10 and the end plates require some modification to conform with the principles of FIG. 6 or FIG. 7.

Operation of the embodiments described is, it is believed, self-evident. Compressed air applied at the front of the actuator to an end of one cylinder is fed through the air distribution system to the other end of the other cylinder causing the pistons to provide a balanced torque to the pinion and thence to the valve being controlled.

The actuator will remain in this condition until compressed air is applied to the front end of the other cylinder (and through the air distribution system to the rear end of the first cylinder) to restore the actuator to its original condition. In many applications of the actuator this simple operation is sufficient but there are also applications when it is necessary to ensure that in the event the compressed air supply fails the actuator is returned automatically to a specified condition, e.g. the valve being controlled by the actuator must be closed.

In the embodiments described this is done simply by locating in the bore 40 in the pistons compression springs 42 (see FIG. 13) which, acting between an end plate and the piston, bias the pistons in opposite directions and thus the central gear in one direction, e.g. to close the valve. With the springs located inside the pistons it is relatively easy to achieve a satisfactory spring characteristic, i.e. sufficient force when extended to maintain a valve fully closed, for example, without excess force when compressed. Moreover, it is possible to vary the strength of the springs simply by nesting concentrically various combinations of spiral springs in each piston.

Figure 19:
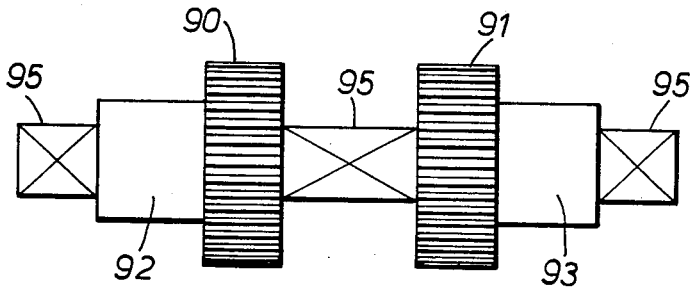
FIGS. 19 and 20 are an elevation and a longitudinal section of a modified central gear.
Figure 20:
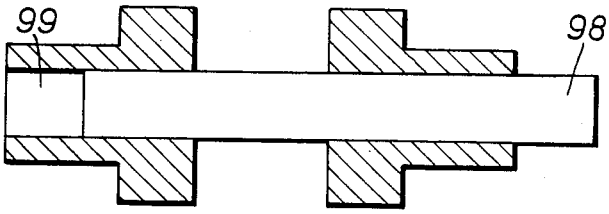

Further modifications may be made to the embodiments described. For example, the central gear may take the form shown in FIGS. 19 and 20 in which two gears 90 and 91 with integral ground bearing sleeves 92 and 93 respectively and having square internal holes are secured by, for example, mechanical locking, bonding or welding to a standard rod 95 of square section. This simple design is particularly suitable for use with larger sizes of actuators and has the additional advantage that, by simply shortening the rod 95 so that it ends at 97, it is possible to provide a male square 98 at one end and a female square 99 at the other end (FIG. 20). Thus, the actuator can be used without an additional coupling both with valves having a female square and with valves having a male square.

Moreover, in the larger sizes of actuators it may be desirable, to avoid casting problems, to make the body 10 of two half castings.

I claim:

1. A quarter turn actuator, comprising:

a body defining two parallel spaced-apart cylinders at least partly coextensive with one another through said body, a transverse bore in said body which opens into each of said cylinders, a pair of pistons each formed of plastics material and arranged for reciprocating movement in a different one of said cylinders, each of said pistons having in its external circumferential surface said recess facing toward a transverse bore, at least one of said pistons being hollow defining a closed axial end face of said piston and an axial bore, the bottom of said axial bore being near said closed axial end face of the piston, said axial bore being open at the opposite end face of the piston, a rack embedded in a bottom wall of the recess on the external circumferential surface of each piston, a pinion mounted in said transverse bore in said body and engaging each of the racks embedded in said pistons for rotation in response to movement of said pistons in opposite directions, means for supplying compressed air to both said cylinders, biasing means seated in said axial bore of said at least one piston to contact the bottom of said axial bore and extending axially also to contact a part of said body facing said opposite end face of the piston for biasing the piston in a direction which causes said pinion to rotate in a desired direction in the absence of said compressed air, and an air distribution system interconnecting each end of each cylinder with the other end of the other cylinder for allowing said air supplying means to communicate with the interconnected ends of said cylinders in said body to enable movement of said pistons to rotate said pinion in a selected direction of rotation.

2. An actuator as claimed in claim 1, in which a metal member extends from one axial end of said at least one piston to the other end within said axial bore.

3. An actuator as claimed in claim 2, including an adjustable stop cooperable with the metal member to limit movement of the piston in its cylinder.

4. An actuator as claimed in claim 3, including a proximity detector for sensing the metal member and signalling its position in its cylinder.

5. An actuator as claimed in claim 1, in which an end of each piston is reinforced by a metal disc.

6. An actuator as claimed in claim 1, in which the body of the actuator is made of plastics material and the wall of each cylinder is reinforced by a liner tube.

7. An actuator as claimed in claim 6, in which said tube is glass fibre reinforced epoxy resin.

8. An actuator as claimed in claim 7, in which the rack on each piston comprises two parallel spaced-apart coextensive lengths of toothed track.

9. An actuator as claimed in claim 8, in which said air distribution system includes passages in said body.

10. An actuator as claimed in claim 9, in which said cylinders are closed by end plates and the air distribution system includes passages in said end plates.

11. An actuator as claimed in claim 10, in which said pinion is mounted between collars in said body, and in which at least one of said collars is provided with a groove forming part of said air distribution system.

12. An actuator as claimed in claim 11, in which a passage in said body is aligned with said groove.

13. An actuator as claimed in claim 12, in which an air tube passes through said passage and said groove and secures the collar in position in the body.

14. An actuator as claimed in claim 13, in which the air distribution system comprises passages extending longitudinally through the body and transversely extending passages.

15. An actuator as claimed in claim 14, in which the transversely extending passages include collar grooves.

16. An actuator as claimed in claim 14, in which the transversely extending passages are defined by said end plates.

* * * * *